US009648437B2

(12) United States Patent
Bonnick et al.

(10) Patent No.: US 9,648,437 B2
(45) Date of Patent: May 9, 2017

(54) SYSTEMS AND METHODS FOR MONITORING CINEMA LOUDSPEAKERS AND COMPENSATING FOR QUALITY PROBLEMS

(75) Inventors: Brian John Bonnick, Ontario (CA); Denis G. Tremblay, Ontario (CA)

(73) Assignee: IMAX CORPORATION, Ontario (CA)

( * ) Notice: Subject to any disclaimer, the term of this patent is extended or adjusted under 35 U.S.C. 154(b) by 896 days.

(21) Appl. No.: 13/388,428

(22) PCT Filed: Aug. 3, 2010

(86) PCT No.: PCT/IB2010/001920

§ 371 (c)(1),
(2), (4) Date: Feb. 1, 2012

(87) PCT Pub. No.: WO2011/015932

PCT Pub. Date: Feb. 10, 2011

(65) Prior Publication Data

US 2012/0140936 A1 Jun. 7, 2012

Related U.S. Application Data

(60) Provisional application No. 61/230,833, filed on Aug. 3, 2009.

(51) Int. Cl.
*H04R 29/00* (2006.01)
*H04S 7/00* (2006.01)
(Continued)

(52) U.S. Cl.
CPC ..... *H04S 7/301* (2013.01); *H04R 3/04* (2013.01); *H04R 29/007* (2013.01); *H04R 27/00* (2013.01);
(Continued)

(58) Field of Classification Search
USPC ..... 381/59, 310, 1, 2, 17, 18, 303, 309, 97, 381/61, 66, 58, 63, 82, 122; 704/503,
(Continued)

(56) References Cited

U.S. PATENT DOCUMENTS 1,697,500 A 1/1929 Friend
3,814,856 A 6/1974 Dugan
(Continued)

FOREIGN PATENT DOCUMENTS

DE 10254404 6/2004
DE 10254470 1/2006
(Continued)

OTHER PUBLICATIONS

Lingvall et al, multiple point statistical room correction for audio reproduction minimum mean squared error correction filtering, ASA Apr. 2009.*

(Continued)

*Primary Examiner* — Davetta W Goins
*Assistant Examiner* — Kuassi Ganmavo
(74) *Attorney, Agent, or Firm* — Kilpatrick Townsend & Stockton LLP

(57) ABSTRACT

Systems and processes for compensating for changes in a theatre sound system positioned in a theatre are described. A subsequent response of a loudspeaker to a test signal is captured and compared to a previously obtained signature response of the loudspeaker to the test signal. An audio signal can be processed based on the comparison to compensate for changes to loudspeaker performance, or otherwise.

21 Claims, 9 Drawing Sheets

(51) Int. Cl.
*H04R 3/04* (2006.01)
*H04R 27/00* (2006.01)
*H04S 3/00* (2006.01)

(52) U.S. Cl.
CPC ..... *H04R 29/001* (2013.01); *H04R 2227/007* (2013.01); *H04S 3/002* (2013.01)

(58) Field of Classification Search
USPC ..... 704/504; 700/94; 84/630, 610, 626
See application file for complete search history.

(56) References Cited

U.S. PATENT DOCUMENTS

| | | | | |
|---|---|---|---|---|
| 4,209,663 | A | 6/1980 | Sekiguchi | |
| 5,131,051 | A * | 7/1992 | Kishinaga | H04R 27/00 381/63 |
| 5,144,673 | A * | 9/1992 | Matsumoto et al. | 381/61 |
| 5,222,059 | A | 6/1993 | Holman | |
| 5,727,066 | A * | 3/1998 | Elliott et al. | 381/1 |
| 5,798,818 | A | 8/1998 | Derderian et al. | |
| 5,801,754 | A | 9/1998 | Ruybal et al. | |
| 6,072,878 | A | 6/2000 | Moorer | |
| 6,088,461 | A | 7/2000 | Lin et al. | |
| 6,192,215 | B1 | 2/2001 | Wang | |
| 6,195,435 | B1 | 2/2001 | Kitamura | |
| 6,409,599 | B1 | 6/2002 | Sprout et al. | |
| 6,697,492 | B1 * | 2/2004 | Yamaguchi et al. | 381/103 |
| 6,782,104 | B1 | 8/2004 | Vieilledent | |
| 6,798,889 | B1 | 9/2004 | Dicker et al. | |
| 6,816,577 | B2 | 11/2004 | Logan | |
| 6,856,688 | B2 | 2/2005 | Cromer et al. | |
| 6,881,892 | B2 * | 4/2005 | Miyazaki et al. | 84/736 |
| 6,983,225 | B2 | 1/2006 | Sprogis et al. | |
| 7,043,027 | B2 | 5/2006 | Wood | |
| 7,072,474 | B2 * | 7/2006 | Nelson et al. | 381/17 |
| 7,313,246 | B2 | 12/2007 | Miller et al. | |
| 7,339,492 | B1 | 3/2008 | Alexander | |
| 7,379,850 | B2 | 5/2008 | Sprogis et al. | |
| 7,388,962 | B2 | 6/2008 | Cheung et al. | |
| 7,769,183 | B2 * | 8/2010 | Bharitkar et al. | 381/59 |
| 8,098,841 | B2 * | 1/2012 | Sawara et al. | 381/83 |
| 8,150,047 | B2 * | 4/2012 | Rabinowitz et al. | 381/59 |
| 8,199,921 | B2 * | 6/2012 | Katayama et al. | 381/63 |
| 8,213,637 | B2 * | 7/2012 | Brannmark et al. | 381/98 |
| 2002/0136414 | A1 | 9/2002 | Jordan et al. | |
| 2002/0159611 | A1 | 10/2002 | Cromer et al. | |
| 2004/0091120 | A1 * | 5/2004 | Kantor et al. | 381/61 |
| 2004/0179696 | A1 * | 9/2004 | Ohta | 381/56 |
| 2004/0208333 | A1 | 10/2004 | Cheung et al. | |
| 2005/0175197 | A1 | 8/2005 | Melchior et al. | |
| 2005/0195986 | A1 | 9/2005 | McCarty et al. | |
| 2005/0207592 | A1 * | 9/2005 | Sporer | H04S 7/30 381/94.2 |
| 2005/0254640 | A1 | 11/2005 | Ohki et al. | |
| 2005/0278764 | A1 | 12/2005 | Barr | |
| 2006/0062395 | A1 | 3/2006 | Klayman et al. | |
| 2006/0062397 | A1 | 3/2006 | Cooper | |
| 2006/0062398 | A1 | 3/2006 | McKee Cooper et al. | |
| 2006/0115095 | A1 * | 6/2006 | Giesbrecht et al. | 381/66 |
| 2006/0222186 | A1 | 10/2006 | Paige et al. | |
| 2007/0036281 | A1 | 2/2007 | Schulein et al. | |
| 2008/0091418 | A1 * | 4/2008 | Laaksonen | G10L 25/90 704/217 |
| 2008/0239164 | A1 | 10/2008 | Liang et al. | |
| 2008/0260170 | A1 * | 10/2008 | Nakano | 381/59 |
| 2008/0267413 | A1 | 10/2008 | Faller | |
| 2008/0279410 | A1 | 11/2008 | Cheung et al. | |
| 2008/0281451 | A1 | 11/2008 | Aoki et al. | |
| 2010/0150359 | A1 * | 6/2010 | KnicKrehm et al. | 381/58 |
| 2014/0119551 | A1 * | 5/2014 | Bharitkar | H04R 29/001 381/59 |

FOREIGN PATENT DOCUMENTS

| | | | |
|---|---|---|---|
| DE | 102006053919 | | 4/2008 |
| EP | 624947 | | 11/1994 |
| EP | 1514450 | | 12/2005 |
| EP | 1576847 | | 4/2006 |
| EP | 1761110 | | 3/2007 |
| GB | 674753 | | 7/1952 |
| GB | 789069 | | 1/1958 |
| GB | 815978 | | 7/1959 |
| JP | 04115127 | | 4/1992 |
| JP | 07095684 | | 4/1995 |
| JP | H11285100 | H * | 10/1999 |
| JP | 2005316173 | | 11/2005 |
| JP | 2005316173 | A * | 11/2005 |
| JP | 2008228133 | | 9/2008 |
| RU | 2353004 | | 4/2009 |
| RU | 2353004 | C1 * | 4/2009 |
| WO | 8902682 | | 3/1989 |
| WO | 9917442 | | 4/1999 |
| WO | 9966728 | | 12/1999 |
| WO | 0060857 | | 10/2000 |
| WO | 0139070 | | 5/2001 |
| WO | 0205904 | | 1/2002 |
| WO | 2006107584 | | 10/2006 |
| WO | WO 2007016465 | A2 * | 2/2007 |
| WO | 2007026025 | | 3/2007 |
| WO | 2008043549 | | 4/2008 |
| WO | 2008121913 | | 10/2008 |

OTHER PUBLICATIONS

Johansen, previous scientific approaches to loudspeakers and room equalization, 2006.*

"Finite Impulse Response", http://en.wikipedia.org/wiki/Finite_impulse_response, Jul. 28, 2010, 8.

International Patent Application No. PCT/IB2010/001920 , "International Preliminary Report on Patentability", Feb. 16, 2012, (6 pages).

International Patent Application No. PCT/IB2010/001920 , "International Search Report and Written Opinion", Dec. 13, 2010 (8 pages).

Japanese Patent Application No. 2012-523400 , "Office Action", mailed Nov. 12, 2013 (4 pages).

Chine Patent Application No. 201080034769.5, First Office Action issued on Mar. 3, 2014, 24 pages.

Japanese Application No. 2012-523400, Office Action mailed on Aug. 12, 2014, 3 pages.

Russian Application No. 2012108093/28(012197), Office Action mailed on Jul. 2, 2014, 18 pages.

Chinese Application No. 201080034769.5, Office Action mailed on Jan. 6, 2015, 21 pages (containing 11 pages of the English translation and 10 pages of the original document).

Russian Application No. 2012108093, Notice of Allowance mailed on Jul. 29, 2015, 18 pages (11 pages of Notice of Allowance and 7 pages of English translation).

Chinese Application No. 201080034769.5, Office Action mailed on Sep. 1, 2015, 5 pages (3 pages of Office Action and 2 pages of English translation).

Chinese Application No. 201080034769.5, Office Action mailed on Feb. 6, 2016, 12 pages (5 pages for the original document and 7 pages for the English translation).

Japanese Application No. 2015-019290, Office Action mailed on Mar. 8, 2016, 6 pages (3 pages for the original document and 3 pages for the English translation).

European Patent Application No. 10806115.1, Extended Search Report mailed Apr. 21, 2016 (8 pages).

Elliott et al., "Multiple-Point Equalization in a Room Using Adaptive Digital Filters", Journal of the Audio Engineering Society, Audio Engineering Society, vol. 37, No. 11, Nov. 1, 1989, pp. 899-907.

Japanese Patent Application No. 2015-019290, Office Action mailed Oct. 25, 2016, 7 pages (4 pages for the original document and 3 pages for the English translation).

(56) References Cited

OTHER PUBLICATIONS

Chinese Application No. 201080034769.5, Notice of Allowance mailed on Jul. 6, 2016, 7 pages (No English translation of the Notice of Allowance is available. However, an English translation of allowed claims is submitted).

* cited by examiner

SYSTEMS AND METHODS FOR MONITORING CINEMA LOUDSPEAKERS AND COMPENSATING FOR QUALITY PROBLEMS

CROSS-REFERENCE TO RELATED APPLICATIONS

This application is a U.S. national phase patent application under 35 U.S.C. 371 of International Patent Application No. PCT/IB2010/001920 entitled "Systems and Methods for Monitoring Cinema Loudspeakers and Compensating for Quality Problems" filed Aug. 3, 2010, which claims benefit of priority under PCT Article 8 of U.S. Provisional Application No. 61/230,833, titled "Systems and Methods for Monitoring Cinema Loudspeakers and Compensating for Quality Problems" filed on Aug. 3, 2009. Both applications are incorporated herein by reference in their entireties.

TECHNICAL FIELD

Embodiments relate to monitoring sound quality from one or more loudspeakers and compensating, if needed, audio signals to be outputted on the loudspeakers, and more particularly relate to compensating signals based on a signature response of a loudspeaker to a test signal and a subsequent response of the loudspeaker to the test signal.

BACKGROUND

The cinema industry continues to become more competitive. In view of such competition, the trend is to automate as much of the sequencing of the cinematic presentation process as possible to reduce costs. The cinematic presentation includes a sound component and a visual component that are properly sequenced with respect to each other. With the emergence of digital projection and sound systems in theatres it has become easier to automate the cinematic presentation sequencing using computer-controlled show automation systems such that staff is not required to set-up the projector and sound system each time the presentation is run. Accordingly, the presentation quality (e.g. the sound and visual performance) may be monitored less frequently.

For organizations that take pride to ensure the theatre patron is provided the best show experience possible, quality problems can be an ongoing concern. In particular the sound quality problems associated with the degradation of the sound system can result in the sound not meeting the quality sound expected by the theatre patron and can reduce the experience of a premium presentation.

Cinema loudspeaker systems need to perform reliably for extended periods. This is in conflict with the natural changes in the loudspeaker characteristics due to aging or changing environmental conditions, such as temperature and humidity. These natural changes, among other changing performance characteristics, are a typical problem that occurs over time. Other potential performance issues include (i) one driver in a cluster of drivers within a loudspeaker fails or is experiencing a degradation because of a loose connection or otherwise; (ii) a fuse blows, leaving inoperable the mid-range driver(s) or high range driver(s); and (iii) audio amplifier degradation or failures to degraded sound in the theatre. One approach to recognize one or more of these deficiencies is to repeat a theatre sound system tuning test to determine a performance deficiency.

Additionally, the acoustics of the theatre hall can change depending on the number of viewing patrons present (i.e. acoustics can be different if the theatre is full than if the theatre is nearly empty) and the location within the hall of where the patrons are seated. If the acoustics of the hall has changed, causing a reduction in sound quality, adjustments to the equalization of the sound system may be required to compensate for the change.

Typically initial tuning of the sound system is performed during theatre sound system installations in which the performance of the sound system setup is measured and calibrated using a microphone. Measuring with the microphone is performed at various seat positions in the theatre to ensure the sound for most if not all seat locations are optimized. Unfortunately, the setup used for calibration does not lend itself to be used as a sound system monitoring setup. This is partially because patrons are in theatre seats during the monitoring (but not during tuning), which ultimately influences the ability of such a setup to be used effectively for monitoring loudspeaker performance. To effectively monitor the sound quality, a microphone is placed a distance away from theatre patrons but still within the sound dispersion profile. This limits locations for monitoring microphone placement. For example, placing a microphone ten feet above a seating patron's head position and outside of the projected image path may potentially place the microphone outside of the sound dispersion profile. Thus, the placement may not be an effective position for sound quality monitoring. Furthermore, temporarily lowering a microphone into position when the patrons are seated is an added element of complication that increases the expense of a monitoring system.

Alternatively, the performance of the loudspeakers can be evaluated during periodic inspections, but this process is time consuming and does not identify problems when the problems occur. For example, periodic inspection does not provide any remedy or compensation for changes in acoustical performance until service can be arranged. As with the installation calibration setup, trained personnel is needed to perform measurements properly in monitoring on a periodic basis, thus making this approach less attractive economically (among other reasons).

In addition, the acoustical effects of nearby surfaces can alter the acoustical transfer characteristics of the microphone significantly if the microphones are placed in sub-optimal (e.g. non-ideal) locations. If measurements are made from these locations without otherwise compensating for the complex interactions that occur (and assuming the measurement hardware has a flat response), the correction applied to the loudspeaker response may be distorted by the acoustics of the microphone location. Accordingly, sub-optimal microphone placement is generally avoided.

The acoustical interaction may be too complex to approximate with a simple weighting filter unique to each microphone in each theatre. Discrepancies between the actual acoustical transfer function and an approximated weighting filter may be interpreted by the measurement system as an error to be corrected. This is undesirable as the loudspeaker response can be corrected to compensate for the microphone response rather than the opposite.

Accordingly, systems and methods for theatre sound quality monitoring are desirable that can be implemented using microphones placed in a variety of positions, including sub-optimal positions. Systems and methods are also desirable that can monitor for theatre sound quality effectively to compensate quality problems automatically. Systems and methods are also desirable that can identify larger issues with a theatre sound system and notify theatre operators regarding those larger issues.

SUMMARY

In at least one aspect, a method is described for compensating for changes in a theatre sound system that is positioned in a theatre. A difference between a signature response of a loudspeaker to a test signal and a subsequent response of the loudspeaker to the test signal is determined. The subsequent response of the loudspeaker is subsequent to the signature response of the loudspeaker. The loudspeaker is in the theatre sound system. The signature response and the subsequent response are captured by a microphone at a suboptimal position in the theatre. An audio signal is modified by an equalizer unit based on the difference to generate a compensated audio signal. The compensated audio signal is outputted to the loudspeaker.

In at least one embodiment, the audio signal is modified based on the difference to generate the compensated audio signal by determining an inverse of the difference and convolving the inverse of the difference with the audio signal.

In at least one embodiment, the difference between the signature response and the subsequent response is determined by determining an inverse of the signature response. The inverse of the signature response is used to determine a correction to linearize the signature response to a predetermined limit. The correction is applied to the subsequent response to generate a corrected response. The corrected response is compared to the predetermined limit to determine the difference. The difference represents an amount by which to linearize the corrected response to the predetermined limit.

In at least one embodiment, the test signal includes audio of at least one frequency in a hearing range of a human.

In at least one embodiment, the test signal includes at least one of an impulse signal, a chirp signal, a maximum length sequence signal, or a swept sine signal.

In at least one embodiment, a microphone positioned at a suboptimal position in the theatre captures the subsequent response of the loudspeaker to the test signal.

In at least one embodiment, the subsequent response of the loudspeaker to the test signal is captured by capturing the subsequent response when at least one person is located in the theatre.

In at least one embodiment, the microphone positioned at the suboptimal position captures the signature response of the loudspeaker to the test signal prior to capturing the subsequent response of the loudspeaker to the test signal.

In at least one embodiment, the theatre sound system is tuned prior to determining the difference.

In at least one embodiment, the differences are determined and the motion picture audio signals are modified based on the differences, periodically.

In another aspect, a system is provided that is capable of compensating for changes in performance of a theatre sound system that is positioned in a theatre. The system includes an equalizer unit. The equalizer unit can receive a signature response of a loudspeaker to a test signal and receive a subsequent response of the loudspeaker to the test signal. The equalizer unit can modify an audio signal using a difference between the signature response and the subsequent response and can output to the loudspeaker the audio signal modified based on the difference. The equalizer unit is capable of determining the difference.

In at least one embodiment, the system includes an audio processing device that includes a playback device, an audio processor, an amplifier, and a user console. The playback device can source the audio signal. The audio processor can synchronize and process the audio signal. The amplifier can drive the loudspeaker. The user console can allow a user to control the playback device and the audio processor. The equalizer unit can generate the test signal.

In at least one embodiment, the equalizer unit can, in response to determining the subsequent response is between predetermined low limits, output to the loudspeaker the audio signal without being modified based on the difference. The equalizer unit can, in response to determining the subsequent response exceeds a predetermined high limit, output a notification to a user interface for a theatre operator without modifying the audio signal based on the difference. The equalizer unit can modify the audio signal based on the difference and output to the loudspeaker the audio signal modified based on the difference, in response to determining the subsequent response is between at least one predetermined low limit and at least one predetermined high limit.

In another aspect, a theatre sound system is described. The system includes a loudspeaker, a microphone, and an audio device. The loudspeaker is positioned in an auditorium. The microphone is positioned in a suboptimal location in the auditorium and within an audio dispersion path associated with the loudspeaker. The microphone can capture a signature response and a subsequent response of the loudspeaker to a test signal. The audio device can generate a difference between the signature response and the subsequent response and can modify an audio signal of a motion picture based on the difference to generate a compensated signal that is capable of compensating for changes causing degradation of sound quality in the loudspeaker since the signature response.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Certain aspects and embodiments relate to a theatre sound quality monitoring system. In one embodiment, the system is capable of receiving signals from quality monitoring microphones positioned at sub-optimal positions. The system can be "taught" a signature response of the loudspeaker to a test signal as measured through one or more of the quality monitoring microphones after the theatre sound system is tuned using tuning microphones placed at optimal locations. The signature response can have localized acoustical effects incorporated into the microphone's measurement of the test signal. Subsequent measurements of the loudspeaker's response to the test signal can include the same localized acoustical effects. The localized acoustics can be fixed due to the walls, floor, ceiling and screen, along with the microphone and the loudspeaker, not changing position. Other effects can change due to one or more variables and those effects can be identified.

For example, both the signature response and the subsequent response can include an acoustical transfer function associated with the microphone location. The portion of the response influenced by the acoustical transfer function in both measurements is subtracted out when the subsequent response is subtracted from the signature response to determine a difference. The difference may represent an error or otherwise a change that the system can identify and correct.

In some embodiments, the difference between the signature response and the subsequent response is analyzed. If the difference is sufficient, such as by being above a predetermined limit, the system can perform adjustments to equalization settings that control frequency profile of the audio channel to the loudspeaker so that the loudspeaker's response to the test signal can be corrected. This may be performed for each loudspeaker in the theatre such that the theatre sound system can perform within acceptable limits. This may be performed prior to each presentation to allow for a more immediate response to an acoustical quality problem. If the sound quality problem can be corrected by making audio signal equalization adjustments, then the compensation can be applied prior to each show. These adjustments may not be possible in normally scheduled sound system service routines, which are often performed once or twice a year.

In some embodiments, a needed adjustment to correct a loudspeaker response that exceeds a second predefined limit is electronically flagged and a notification regarding the adjustment is provided to a system operator or other appropriate personnel by electronic means.

In some embodiments, quality checks of the theatre sound system are performed by the system periodically, such as on a per show basis, a daily routine.

Figure 1:
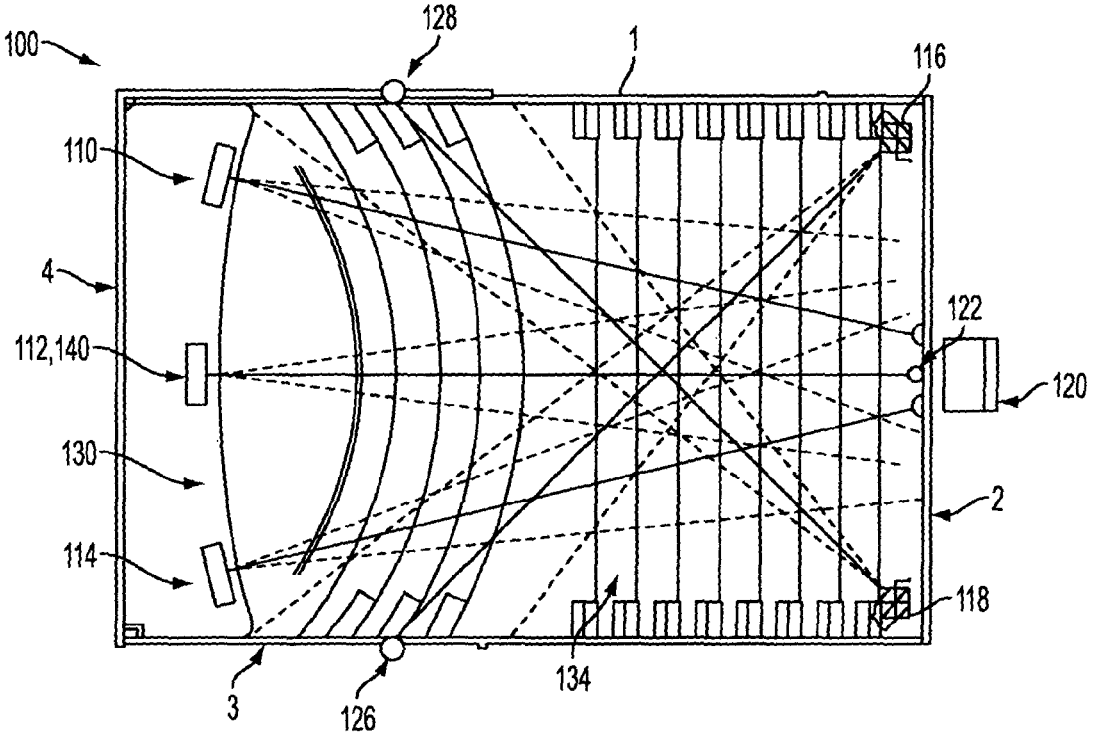
FIG. 1 is a top view of a theatre with placement of theatre sound quality microphones according to one embodiment of the present invention.
Figure 2:
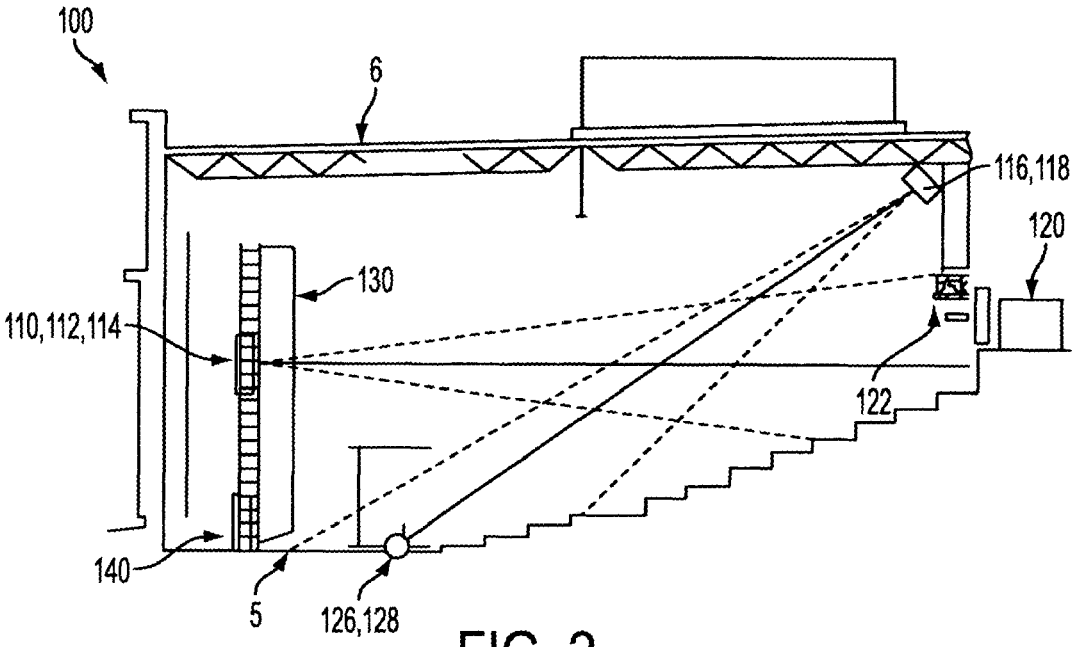
FIG. 2 is a side view of the theatre of FIG. 1 with placement of theatre sound quality microphones according to one embodiment of the present invention.

FIGS. 1-2 depict a cinema theatre hall with a theatre sound quality monitoring system according to one embodiment. The theatre hall is enclosed by four walls 1, 2, 3, 4, a floor 5, and a ceiling 6. A screen 130 is provided on one end of the hall. A visual presentation can be displayed on the screen 130. A projector 120, which can create an image on the screen 130, can be located at the opposite end of the hall from the screen 130. Seats are located in rows 134 throughout the hall for patrons to sit and view the presentation. For the audible portion of the presentation, loudspeakers can be located behind center screen (e.g. loudspeaker 112), behind the left side of the screen (e.g. loudspeaker 114) and behind the right side of the screen (e.g. loudspeaker 110). Loudspeakers 116, 118 can be positioned at or near the rear of the theatre on each side. Sub-bass loudspeaker 140 can be positioned behind the screen at a lower center portion. Positioning the loudspeakers around the audience can allow the presentation sounds to be realistically positioned with respect to the visual content of the presentation.

A selected number of microphones can be placed in the presentation hall to monitor the sound system quality. The microphones can be placed within an appropriate portion of the sound dispersion pattern of each loudspeaker to, for example, avoid interfering with the patron's view of the presentation. Any number of microphones can be used. In a theatre hall with a loudspeaker distribution described above, three microphones can be used for quality monitoring of the sound system. One microphone 122 can be located along the back wall such that it is within a dispersion pattern of the loudspeakers behind the screen, allowing sound from these loudspeakers to be monitored. To monitor the sound from the loudspeakers positioned near or at the rear of the theatre, two microphones 126, 128 can be positioned along one or more theatre side walls in line with the direction of each respective rear loudspeaker's sound dispersion pattern. The sub-bass loudspeaker 140 can have omni-directional dispersion characteristics such that any one or more of the monitoring microphones 122, 126, 128 can be used to monitor the sub-bass loudspeaker 140.

The sound dispersion pattern of cinema loudspeakers can be broad to ensure best coverage over the audience seat locations. Given this spatially controlled directivity of the sound, the microphones can be positioned in locations within a defined area as outlined by the dotted lines emanating from each loudspeaker position shown in FIGS. 1-2 and do not need to be positioned directly in line with a center axis of the loudspeaker. The angle spanned by the dotted lines may vary with different drivers.

Systems according to various embodiments of the present invention can include any configuration that can identify sound quality issues in a theatre sound system and to compensate for at least some of the identified sound quality issues. In some embodiments, the system includes an audio device that implements methods according to various embodiments of the present invention using hardware, software stored on a computer-readable medium, or a combination of hardware and software.

Figure 3:
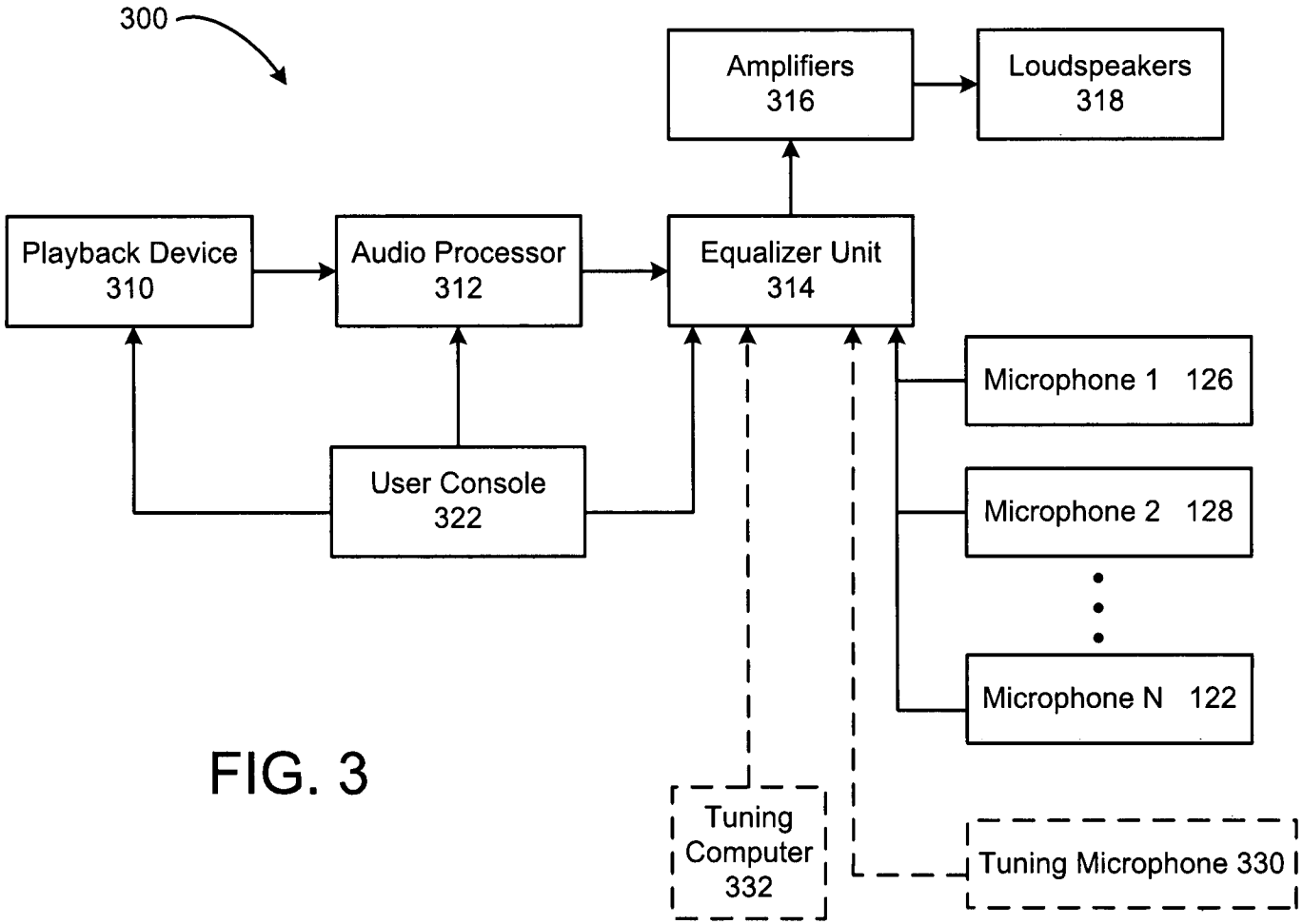
FIG. 3 is a block diagram of a theatre sound quality monitoring system with a theatre sound system according to one embodiment of the present invention.

Audio devices can include one or more components or functional components. FIG. 3 is a block diagram of an audio device that is a sound quality monitoring system 300 integrated with a theatre sound system according to one embodiment. The sound system 300 includes a playback device 310, an audio processor 312, an equalizer unit 314, audio amplifiers 316 and loudspeakers 318. A user console 322 can allow sound tracks to be selected by a user, as well as providing the ability to make other adjustments to the playback device 310, audio processor 312, and equalizer unit 314. The audio processor 312 can receive the audio data from the playback device 310 and can format the data for each of the audio channels in the sound system.

In the sound system configuration of theatre hall 100, at least five audio channels and one sub-bass channel can be present. The equalizer unit 314 can modify the audio signal to each of the loudspeakers for tuning to optimize the sound in the theatre hall for patrons. Quality monitoring can include providing information from the quality monitoring microphones 122, 126, 128 to the equalizer unit 314. The equalizer unit 314 can send a test signal, receive loudspeaker responses from the microphones, process the received responses and compensate the audio signal based on processed information, such as a difference based on a signature response of a loudspeaker to a test signal and a subsequent response of the loudspeaker to the test signal.

Tuning components, such as a tuning microphone 330 and a tuning computer 332, can be integrated with the system 300. The tuning computer 332 can be a general purpose computer that has been configured to execute a tuning software program stored on a computer-readable medium. The tuning components can be integrated permanently or temporally, as indicated via the dashed lines in FIG. 3. The tuning components can be used during sound system setup, or otherwise, to tune the sound system for optimal performance prior to monitoring the sound system for quality. Tuning of a sound system in a theatre hall can ensure consistent sound quality over the area of seat locations that patrons experience during a presentation.

Before the tuning begins, the theatre hall can be set-up, such as by being configured in a finished condition. A finished condition can include installing elements affecting room acoustics. Examples of these elements include seats, sound absorbing materials, a screen, carpet or other flooring, doors and booth window, and loudspeakers. The elements may be aligned for optimal sound dispersion.

Tuning the theatre sound system can include positioning the tuning microphone 330 at various seat locations while a tuning test signal, programmed within a tuner device such as a tuning computer 332, is applied to one or more of the loudspeakers 318 by the equalizer unit 314. By applying the tuning test signal, the tuning computer 332 can determine optimal tuning parameter settings. Tuning can be used to create an ideal or flat response of a theatre sound system at optimal microphone locations, which correspond to patron seat locations. Tuning parameters can include adjusting a frequency profile and volume levels to the audio channels for each of the loudspeakers 318 to produce an optimal and consistent sound quality over the viewing patron seat locations. At the time of tuning, patrons are absent from seats. In some implementations, the amount of time needed to tune a theatre sound system can be completed in one or two days, or hours, to achieve optimum performance. The tuning process can include multiple measurements and require a professional to interpret the results to make the necessary sound system adjustments. The tuning process also includes placing the microphones at ideal locations, which would be in the field of view of the presentation image if an audience were present. Typically after the tuning is complete the tuning computer 332 and the tuning microphone 330 are removed.

Figure 4:
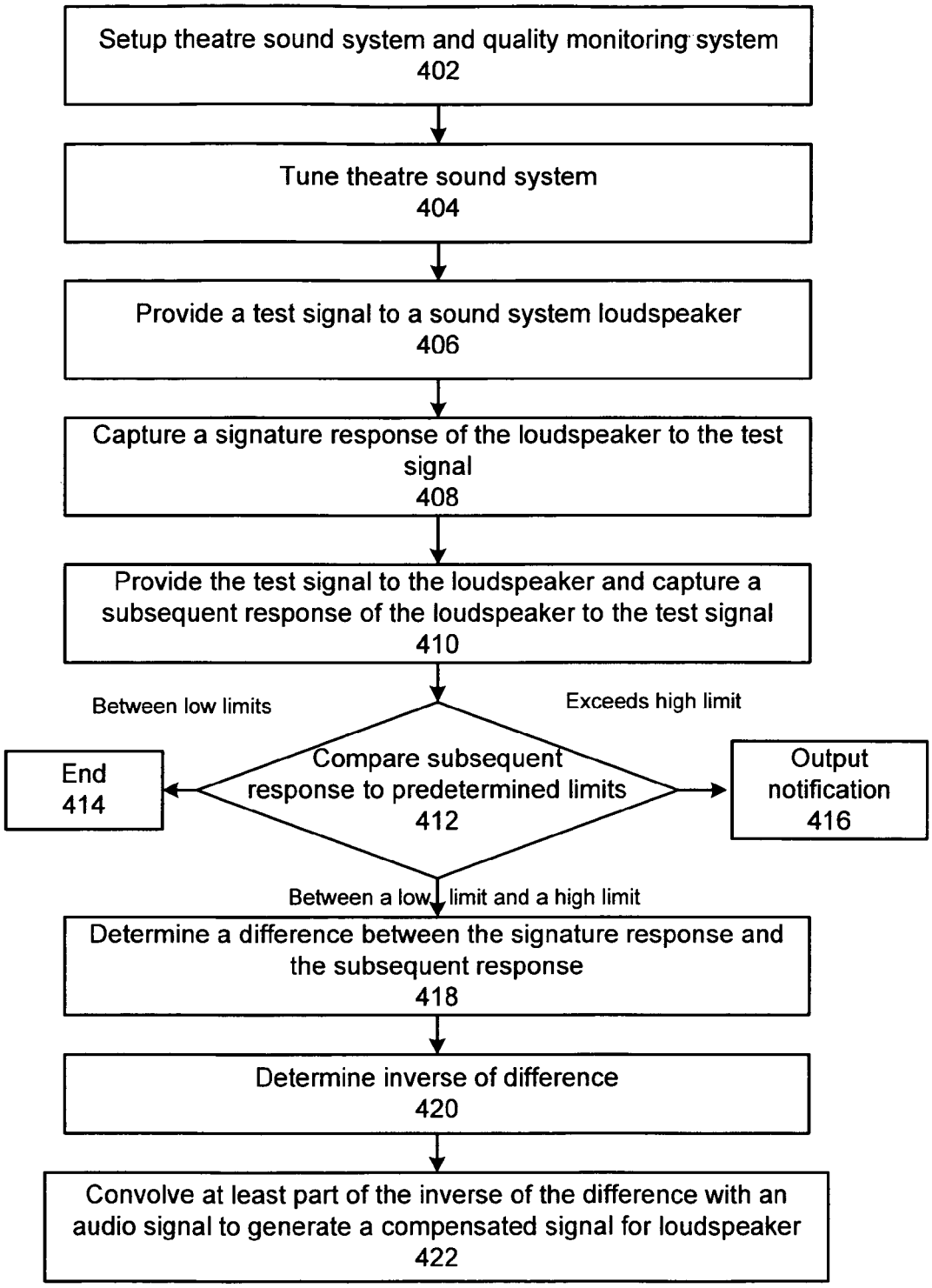
FIG. 4 is a flow chart for a process for monitoring and compensating for theatre sound quality according to one embodiment of the present invention.
Figure 5:
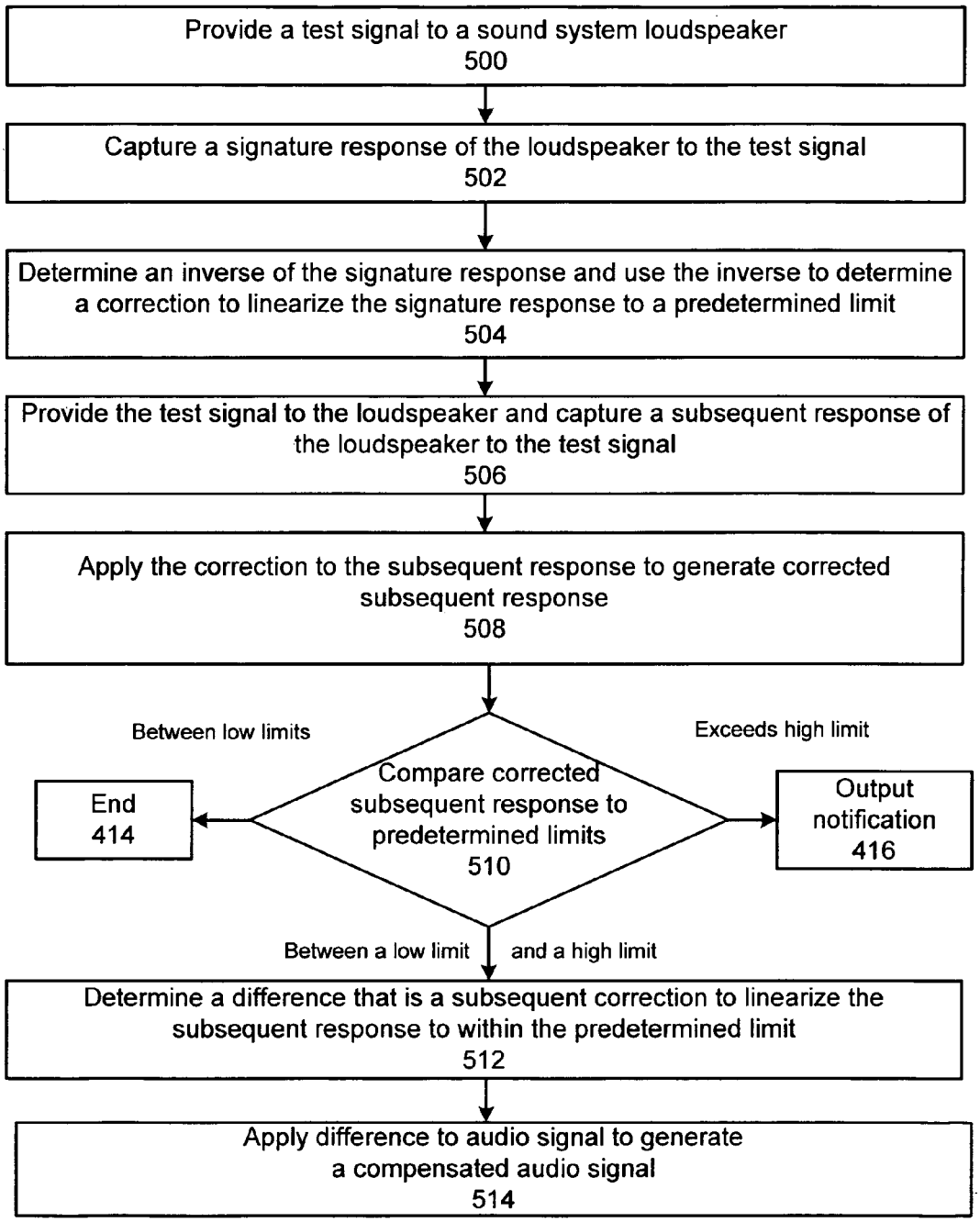
FIG. 5 is a flow chart for process for monitoring and compensating for theatre sound quality according to another embodiment of the present invention.

FIGS. 4-5 depict sound quality monitoring processes according to certain embodiments. The processes of FIGS. 4-5 are described with reference to the system and implementations in FIGS. 1-3. However, other systems and implementations can be used. For example, although various embodiments are described as being implemented in a cinema theatre environment, sound quality monitoring processes according to various embodiments can be implemented in other environments. Examples of such environments include home theatre, theatrical theatre, stage theatre, music hall, performing art theatre, and otherwise sound systems in auditoriums configured for any situation in which a sound system has been setup and that can be monitored using microphones positioned in suboptimal locations.

FIG. 4 shows in block 402 setting up a theatre sound system and quality monitoring system and in block 404 tuning the theatre sound system. These can be performed in accordance with the setup and tuning methods described above with respect to tuning microphone 330 and tuning computer 332. Setup and tuning can be performed during the sound system installation or otherwise prior to sound quality monitoring. Tuning, however, is optional. It is not required to be performed prior to implementing a sound quality monitoring process.

In block 406, the equalizer unit 314 provides a test signal to a loudspeaker. One or more microphones can capture the loudspeaker's response to the test signal as a signature response and provide the signature response to the equalizer unit 314. In a theatre hall configured as in FIGS. 1-2, microphone 122 can receive sound from loudspeakers 110, 112, 114 and sub-bass loudspeaker 140 when an audio signal is applied through the loudspeakers 110, 112, 114 and sub-bass loudspeaker 140. Microphone 126 can receive sound from loudspeaker 116 and sub-bass loudspeaker 140 when an audio signal is applied to the loudspeaker 116 with sub-bass portions applied to the sub-bass loudspeaker 140. Similarly, microphone 128 can receive sound from loudspeaker 118 and sub-bass loudspeaker 140 when an audio signal is applied to the loudspeaker 118 and sub-bass loudspeaker 140. A test signal can be a predetermined audio signal with known frequency characteristics. The signal can include a range of audio frequencies that span at least the human hearing range and/or the range of frequencies at which loudspeakers are capable of producing sounds. An example of a frequency range is 80 Hz to 20 kHz for loudspeakers 110, 112, 114, 116, and 118, and 20 Hz to 80 Hz for the sub-bass loudspeaker 140. Examples of test signals that can be used include an impulse signal, a chirp signal, a maximum length sequence signal, and a swept sine signal. A test signal can originate from the equalizer unit 314, or it can be played back from a playback device 310.

Even though the quality monitoring microphones can be placed in less than ideal locations, they may be appropriately placed to obtain a useful response. For example, because of the suboptimal positioning, the response obtained through the quality monitoring microphones may not have an optimal profile, but the response can indicate what the profile should be at the location of the microphone for a particular loudspeaker of the optimally tuned sound system. The response obtained from the quality monitoring microphones to the test signal just after the theatre sound system is tuned may be a reference signature response. Signature responses captured via a monitoring microphone according to various embodiments are non-ideal and non-flat signals, which are different than signals obtained via optimally placed tuning microphones.

In some embodiments, a signature response can be obtained for each loudspeaker and the signature responses can be recorded. The equalizer unit 314 can store each signature response such that the theatre sound quality monitoring system can be "taught" the signature response of each loudspeaker. Teaching signature responses can be implemented irrespective of periods of time. After being "taught"

the signature response, the system can periodically monitor responses and compensate accordingly as explained below.

Figure 6A:
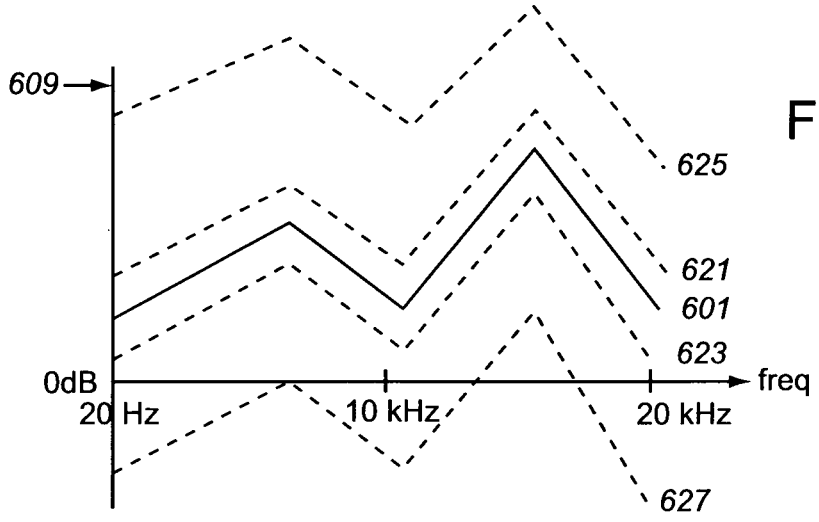
FIG. 6*a* is a chart illustrating a signature response and predetermined limits according to one embodiment of the present invention.

In block 408, a signature response is captured. The signature response is a response to the test signal by a loudspeaker that can be used as a benchmark to compare to responses captured subsequently. FIG. 6*a* depicts one embodiment of a sample signature response 601 acquired via an associated microphone. The response is in the frequency domain over a frequency range of 20 Hz to 20 kHz. The vertical scale represents the magnitude of the reference signature response in dB.

Figure 6B:
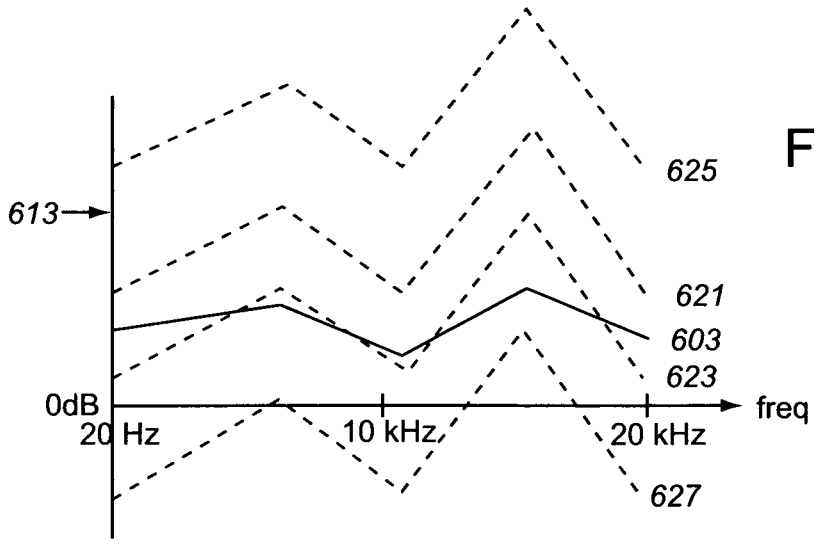
FIG. 6*b* is a chart illustrating a subsequent response and predetermined limits according to one embodiment of the present invention.

A quality monitoring process according to some embodiments can include determining if changes have occurred at some later time in the theatre sound system loudspeaker response. In block 410, the test signal is provided to a loudspeaker and a subsequent response to the test signal is captured. In some embodiments, a set of subsequent responses for each loudspeaker is obtained. FIG. 6*b* illustrates a captured subsequent response 603 to a test signal, subsequent to the signature response, in the frequency domain. The vertical scale represents the magnitude of the subsequent measurement response in dB. If the theatre acoustics and the theatre sound system have not changed over time the subsequent response 603 is the same as the signature response 601. If over time the sound system and room acoustics change (or other changes occur in the sound system), the subsequent response 603 does not have the same profile as the signature response 601.

The subsequent measurements can be made at the beginning or end of a day of presentations, or before each presentation. In one embodiment, the subsequent responses are captured with patrons absent from the theatre. In another embodiment, subsequent responses are captured with the patrons present in the theatre prior to the start of the presentation. For example, the theatre sound quality monitoring system can account for patrons influencing the acoustic response of the monitoring microphones. Certain embodiments of the quality monitoring system can compensate for differences between a full and partially full theatre.

In some embodiments, the type of test signal can determine whether the subsequent response is made with the audience in the theatre. For example, noise produced from the loudspeakers may startle or annoy the audience if an impulse is used. Using a different type of test signal may be more acceptable if doing the subsequent measurement while the audience is present.

In block 412, the equalizer unit 314 compares the subsequent response to predetermined limits to determine whether the system can automatically compensate for the response of the loudspeaker. The predetermined limits can be determined as offsets to the signature response. Examples of predetermined limits are depicted in FIG. 6*a* by dashed lines 621, 623, 625 627. The amount of offset applied to define one or more limits can depend on the amount by which the system can efficiently compensate an audio signal for loudspeaker performance degradation. For example, the setting of lower predetermined limits can be based on the change being so small that most theatre patrons would be unable to detect the sound quality degradation such that it is more efficient for the system to not compensate for the degradation. The setting of higher limits can be based on an amount of needed compensation that is too large for the system to perform. Such amount may indicate more serious problems outside of normal degradation of the system. Serious conditions can be flagged and noted to the theatre operator without the system compensating the audio signal. In some embodiments, the level of each of the defined limits is selectable by a user based on user-judgement.

By comparing the subsequent response to the predetermined limits, the frequencies that have been attenuated or emphasized can be determined. For example, if the attenuation or emphasis of certain frequencies is determined to be minimal by predetermined lower limits, then the audio signal can be outputted without compensating for loudspeaker performance changes and the quality monitoring at least for that time and for that loudspeaker ends in block 414. Dashed lines 621, 623 in FIGS. 6*a-b* represent predetermined lower limits. If the subsequent response is within the area between the lower limits 621, 623, then the system can be configured to output audio signals without compensating for degradation.

If comparing the subsequent response to the predetermined limits results in exceeding a predetermined high limit, then the system can output a notification in block 416 to an operator or otherwise that notifies the operator of the issue to be addressed by the operator or by other means. Examples of such issues include a non-functional loudspeaker or an audio system component that causes the discrepancy. FIGS. 6*a-b* depict examples of higher predetermined limits 625, 627. If the subsequent response exceeds one or both of these higher limits 625, 627, the system can output the notification to an operator.

If comparing the subsequent response to the predetermined limits results in at least part of the subsequent response being between a lower limit and a higher limit, the process proceeds to block 418 to determine compensation for an audio signal. FIG. 6*b* illustrates an example of a least part of a subsequent response Is between at least one of the lower limits 621, 623 and at least one of higher limits 625, 627.

Figure 6C:
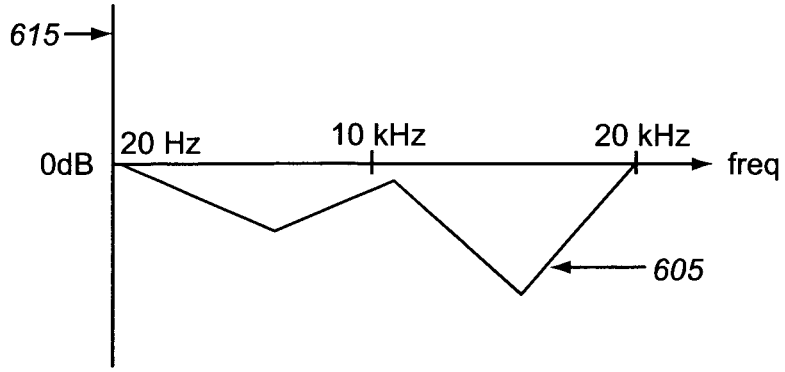
FIG. 6*c* is a chart illustrating a difference between a subsequent response and a signature response according to one embodiment of the present invention.

In block 418, the equalizer unit 314 determines a difference between the signature response and the subsequent response. FIG. 6*c* illustrates an example of a difference 605 between the subsequent response and the signature response in the frequency domain. The vertical scale 615 represents the magnitude of the difference in dB.

Figure 6D:
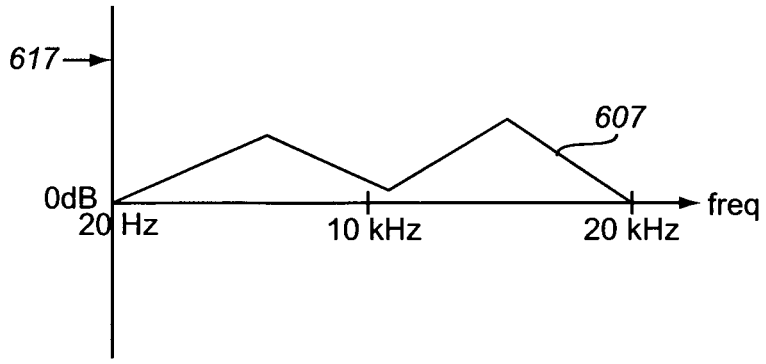
FIG. 6*d* is a chart illustrating an inverse of the difference from FIG. 6*c* according to one embodiment of the present invention.

In block 420, the equalizer unit 314 determines an inverse of the difference. FIG. 6*d* depicts an example of an inverse of the difference 607 of the difference 605 from FIG. 6*c*. The vertical scale 617 represents the magnitude of the inverse of the difference response in dB.

In block 422, the equalizer unit convolves at least part of the inverse of the difference with an audio signal to generate a compensated signal for the loud speaker. In some embodiments, the inverse of the difference is convolved with the audio signal using a digital Finite Impulse Response (FIR) filter. The FIR filter response can be represented by a series summation that has a finite number of terms. Each term in the summation has a filter coefficient. The inverse of the difference of the subsequent response with respect to the signature response can be represented as a series summation where each term has a coefficient. The inverse of the difference is the response desired from the filter. Thus, the coefficients in the series summation for the inverse of the difference can be the filter coefficients. The FIR filter modifies the audio signal based on filter coefficients that can be determined based on the difference. If the test signal is an impulse signal, the difference can be in the time domain. This can represent the inverse of the difference and when convolved with the input audio signal the output signal is the compensated signal to the loudspeakers. To convolve the inverse of the difference with the input audio signal using the FIR filter, the coefficients that control the FIR filter can be determined from the difference.

An impulse test signal is one example of a test signal. Other types of test signals can be used and a compensated signal can be constructed based on the difference between the subsequent response and the signature response. Computations to complete the construction of the compensated signal can be relatively complicated. Other types of equalizer units (e.g. units with infinite impulse response (IIR) filters or analogue filters) that perform equalization by methods with which it is possible to adapt compensation of the audio signal based on the difference between a subsequent response and the signature response for the specific test signal.

In some embodiments, a match of the corrected response for each loudspeaker with its reference signature can be confirmed using the same process outlined above. If there is a difference to be corrected, the new difference can be used to adjust the coefficients of the FIR filter. For example, the process can be used to confirm the compensated audio signal.

The compensated signal can be provided to the loudspeaker for output to theatre patrons.

FIG. 5 depicts a second embodiment of a process for monitoring and compensating for audio quality. The process can also be performed subsequent to theatre tuning and setup processes and can be used to determine more easily coefficients for controlling the FIR filter.

Figure 7A:
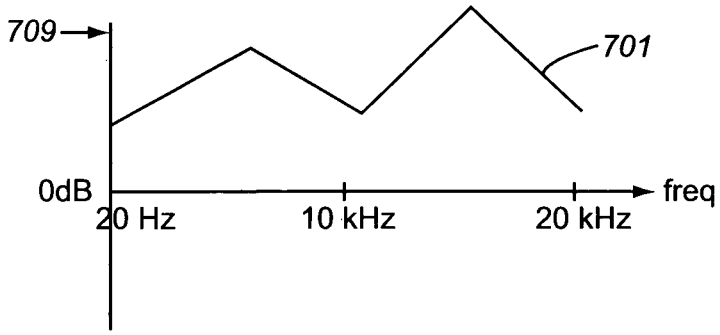
FIG. 7*a* is a chart illustrating a signature response according to one embodiment of the present invention.

In block 500, a test signal is provided to a loudspeaker. In block 502, a signature response of the loudspeaker to the test signal is captured. These processes are similar to those in blocks 406 and 408 of FIG. 4. Furthermore, FIG. 7*a* depicts an example of a captured signature response 701 in the frequency domain from 20 Hz to 20 kHz. The vertical scale (709) represents the magnitude of the measured result in dB.

Figure 7B:
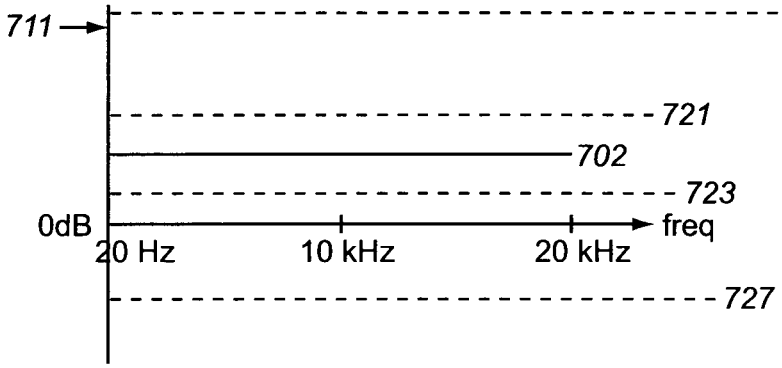
FIG. 7*b* is a chart illustrating a linearized signature response according to one embodiment of the present invention.

In block 504, the equalizer unit 314 determines an inverse of the signature response and uses the inverse to determine a correction to linearize the signature response to a predetermined limit. FIG. 7*b* depicts an example of a linearized result 702 generated by applying coefficients of a control filter in the equalizer unit 314 such that, when applied to the measured result, the result 702 is linear and is between predetermined low limits 721, 723 and predetermined high limits 725, 727. The low and high limits may be offsets with respect to the linearized result determined using similar criteria as described above with respect to FIGS. 4 and 6*a* in determining low and high limits. The linearized result 702 in FIG. 7*b* is depicted in the frequency domain and the vertical scale 711 represents the magnitude in dB.

Figure 7C:
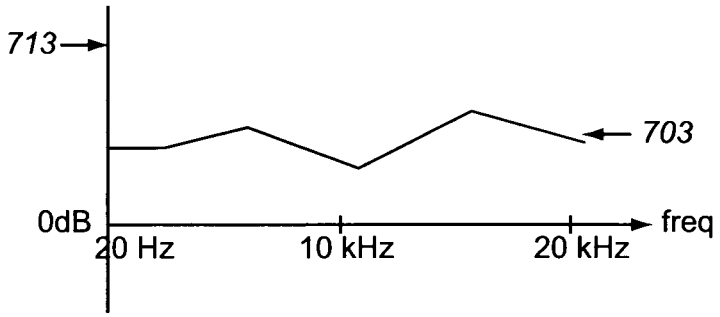
FIG. 7*c* is a chart illustrating a subsequent response according to one embodiment of the present invention.

In block 506, the equalizer unit 314 provides the test signal to the loudspeaker, and a subsequent response of the speaker to the test signal is captured. FIG. 7*c* depicts an example of a subsequent response 703 in the frequency domain. The vertical scale 713 represents the magnitude in dB.

In block 508, the equalizer unit 314 applies the correction to the subsequent response to generate a corrected subsequent response. In some embodiments, the correction is represented by coefficients that control the FIR filter in the equalizer unit 314 that is used to process the subsequent response.

Figure 7D:
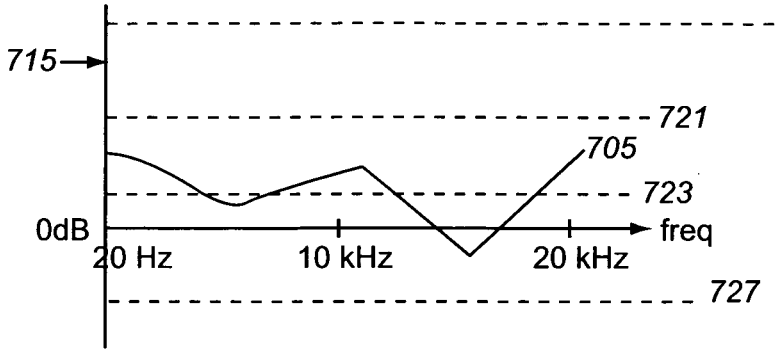
FIG. 7*d* is a chart illustrating a subsequent response and predetermined limits according to one embodiment of the present invention.

In block 510, the equalizer unit 314 compares the corrected subsequent response to predetermined limits. FIG. 7*d* depicts an example of a corrected subsequent response 705 compared to low limits 721, 723 and high limits 725, 727. If the corrected subsequent response is between the low limits 721, 723 (which define an acceptable level of deviation), then the process for this loudspeaker and at this time ends in block 414 and an audio signal is outputted without being compensated. If part of the corrected subsequent response exceeds one or both high limits 725, 727 (which define compensation amounts warranting a notification to an operator), a notification is outputted in block 416.

Figure 7E:
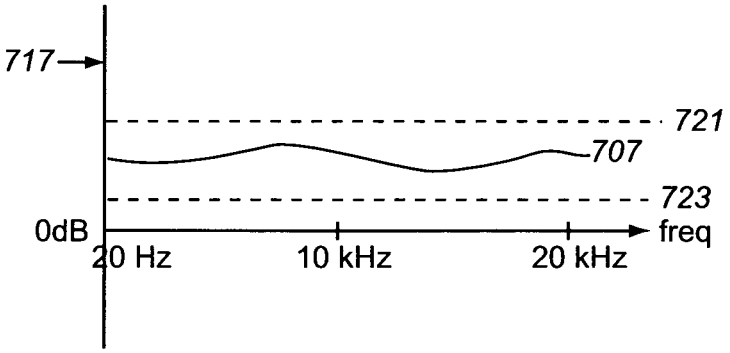
FIG. 7*e* is a chart illustrating a linearized subsequent response according to one embodiment of the present invention.

If the corrected subsequent response is between one of the low limits 721, 723 and one of the high limits 725, 727, the equalizer unit 314 in block 512 determines a difference that is a subsequent correction to linearize the subsequent response to between the low limits 721, 723. FIG. 7*e* depicts an example of a subsequent response 707 linearized using the difference to be between the low limits 721, 723. The response 707 is depicted in the frequency domain via a vertical scale 717 representing magnitude in dB.

In block 514, the equalizer unit 314 applies the difference to an audio signal to generate a compensated audio signal. In some embodiments, equalizer unit uses the difference to adjust filter coefficients of the filter applied to the audio signal to compensate the audio signal. The compensated audio signal can be provided to the loudspeaker for output to theatre patrons.

Processes according to various embodiments of the present invention can be configured to monitor sound quality automatically. This can allow sound quality monitoring to be tied into a cinema's automated show routine to perform sound quality checks automatically and on a routine basis. With this process, compensation for gradual sound system degradation can be performed in an automated way or failed sound system channels can be flagged automatically for immediate action.

Compensation processes according to various embodiments can be completed on those portions of the subsequent response that exceed the first set of low limits, but not the second set of high limits, or the compensation processes can be completed on the whole subsequent response when a portion of the subsequent response exceeds the first, set of limits, but not the second set of limits.

Various methods and processes can be used to determine coefficients for the equalizer filters in accordance with accepted techniques associated with digital filter design. "Advanced Digital Audio" by Ken C. Pohlmann, SAMS (1991), specifically Chapter 10, discloses examples of convolving and processing using digital filters.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

The invention claimed is:

1. A method comprising:

capturing, by a microphone positioned at a suboptimal location that is outside of a patron-seating area in a theatre, a signature response of a loudspeaker in the theatre to a test signal, the signature response representing a desired response, at the suboptimal location, of the loudspeaker, the suboptimal location being a location other than an optimal location for a tuning microphone that is usable to determine an optimal response of the loudspeaker to a tuning test signal;

storing the signature response of the loudspeaker;

correlating the signature response to the optimal response, the signature response indicating what the optimal response should be at the suboptimal location of the microphone for the loudspeaker;

capturing, by the microphone positioned at the suboptimal location, a subsequent response of the loudspeaker to the test signal, the subsequent response representing a changed response, at the suboptimal location and at a time that is subsequent to capturing the signature response, of the loudspeaker;

determining a difference between the signature response and the subsequent response, the difference representing changes in loudspeaker response since capturing the signature response; and compensating for the changes by modifying an audio signal based on the difference to generate a compensated audio signal and outputting the compensated audio signal by the loudspeaker such that a response to the compensated audio signal represents, in the patron-seating area of the theatre, the desired response by the loudspeaker.

2. The method of claim 1, wherein modifying the audio signal based on the difference to generate the compensated audio signal comprises:

determining an inverse of the difference; and convolving the inverse of the difference with the audio signal.

3. The method of claim 1, wherein determining the difference between the signature response and the subsequent response comprises:

determining an inverse of the signature response;

using the inverse of the signature response to determine a correction to linearize the signature response to a predetermined limit;

applying the correction to the subsequent response to generate a corrected response; and comparing the corrected response to the predetermined limit to determine the difference, the difference representing an amount by which to linearize the corrected response to the predetermined limit.

4. The method of claim 1, wherein the test signal comprises audio of at least one frequency in a hearing range of a human.

5. The method of claim 1, wherein the test signal comprises at least one of:

an impulse signal;

a chirp signal;

a maximum length sequence signal; or a swept sine signal.

6. The method of claim 1, wherein capturing the subsequent response of the loudspeaker to the test signal comprises capturing the subsequent response when at least one person is located in the theatre.

7. The method of claim 1, further comprising:

tuning a theatre sound system prior to determining the difference, the theatre sound system including the loudspeaker.

8. The method of claim 1, further comprising:

periodically determining differences and modifying motion picture audio signals based on the differences.

9. The method of claim 1, further comprising:

prior to (i) capturing the subsequent response of the loudspeaker to the test signal and (ii) determining the difference between the signature response and the subsequent response, tuning a theatre sound system that includes the loudspeaker by:

positioning the tuning microphone at the optimal location within the theatre; and determining the optimal response of the loudspeaker to the tuning test signal provided to the loudspeaker; and positioning the microphone at the suboptimal location.

10. A system comprising:

a microphone positionable at a suboptimal location that is outside of a patron-seating area in a theatre for (i) capturing a signature response of a loudspeaker in the theatre to a test signal, the signature response representing a desired response, at the suboptimal location, of the loudspeaker and (ii) capturing a subsequent response of the loudspeaker to the test signal at a time that is subsequent to capturing the signature response, the subsequent response representing a changed response, at the suboptimal location, of the loudspeaker, the suboptimal location being a location other than an optimal location for a tuning microphone that is usable to determine an optimal response of the loudspeaker to a tuning test signal; and an equalizer unit adapted to (i) store the signature response of the loudspeaker, (ii) correlate the signature response to the optimal response, the signature response indicating what the optimal response should be at the suboptimal location of the microphone for the loudspeaker (iii) determine a difference between the signature response and the subsequent response, the difference representing changes in the loudspeaker since capturing the signature response,(iv) compensate for changes to the loudspeaker by modifying an audio signal based on the difference to generate a compensated audio signal and providing the compensated audio signal for output by the loudspeaker such that a response to the compensated audio signal represents the desired response by the loudspeaker in the patron-seating area of the theatre.

11. The system of claim 10, further comprising:

the microphone positioned at the suboptimal location that is within an audio dispersion path of the loudspeaker, the microphone being adapted to capture the signature response and the subsequent response and to output the signature response and the subsequent response to the equalizer unit.

12. The system of claim 10, further comprising an audio processing device, the audio processing device comprising:

a playback device capable of sourcing the audio signal;

an audio processor capable of synchronizing and processing the audio signal;

an amplifier capable of driving the loudspeaker; and a user console capable of allowing a user to control the playback device and the audio processor, wherein the equalizer unit is adapted to generate the test signal.

13. The system of claim 10, wherein the equalizer unit is adapted to:

in response to determining the subsequent response is between predetermined low limits, output to the loudspeaker the audio signal without being modified based on the difference; and in response to determining the subsequent response exceeds a predetermined high limit, output a notification to a user interface for a theatre operator without modifying the audio signal based on the difference, wherein the equalizer unit is adapted to modify the audio signal based on the difference and output to the loudspeaker the compensated audio signal modified based on the difference, in response to determining the subsequent response is between at least one predetermined low limit and at least one predetermined high limit.

14. The system of claim 10, wherein the equalizer unit is adapted to modify the audio signal using the difference by:

determining an inverse of the difference; and convolving the inverse of the difference with the audio signal.

15. The system of claim 10, wherein the equalizer unit is capable of determining the difference by:

determining an inverse of the signature response;

using the inverse of the signature response to determine a correction to linearize the signature response to a predetermined limit;

applying the correction to the subsequent response to generate a corrected response; and comparing the corrected response to the predetermined limit to determine the difference, the difference representing an amount by which to linearize the corrected response to the predetermined limit.

16. The system of claim 10, wherein the test signal comprises audio of at least one frequency in a hearing range of a human.

17. The system of claim 10, further comprising:

the tuning microphone positionable at the optimal location within the theatre, wherein the equalizer unit is adapted to:

tune a theatre sound system that includes the loudspeaker by determining the optimal response of the loudspeaker to the tuning test signal provided to the loudspeaker prior to (i) the subsequent response of the loudspeaker to the test signal being captured and (ii) the difference between the signature response and the subsequent response being determined.

18. A theatre sound system comprising:

a loudspeaker positioned in an auditorium;

a microphone positioned in a suboptimal location that is outside of a patron-seating area in the auditorium and within an audio dispersion path associated with the loudspeaker, the microphone being adapted to capture (i) a signature response of the loudspeaker to a test signal, the signature response representing a desired response, at the suboptimal location, of the loudspeaker and (ii) a subsequent response of the loudspeaker to the test signal at a time that is subsequent to capturing the signature response, the subsequent response representing a changed response, at the suboptimal location, of the loudspeaker, the suboptimal location being a location other than an optimal location for a tuning microphone that is usable to determine an optimal response of the loudspeaker to a tuning test signal; and an audio device adapted to (i) store the signature response of the loudspeaker, (ii) correlate the signature response to the optimal response, the signature response indicating what the optimal response should be at the suboptimal location of the microphone for the loudspeaker, (iii) generate a difference between the signature response and the subsequent response, and (iv) compensate for changes to the loudspeaker by modifying an audio signal of a motion picture based on the difference to generate a compensated signal, wherein the loudspeaker is configured for outputting the compensated signal from the audio device such that a response to the compensated signal represents the desired response by the loudspeaker in the patron-seating area in the auditorium.

19. The system of claim 18, wherein the audio device is adapted to modify the audio signal of the motion picture based on the difference to generate the compensated signal by:

determining an inverse of the difference; and convolving the inverse of the difference with the audio signal of the motion picture.

20. The system of claim 18, wherein the audio device is adapted to generate the difference by:

determining an inverse of the signature response;

using the inverse of the signature response to determine a correction to linearize the signature response to a predetermined limit;

applying the correction to the subsequent response to generate a corrected response; and comparing the corrected response to the predetermined limit to determine the difference, the difference representing an amount by which to linearize the corrected response to the predetermined limit.

21. The theatre sound system of claim 18, further comprising:

the tuning microphone positionable at the optimal location within the auditorium, wherein the audio device is adapted to:

tune the theatre sound system by determining the optimal response of the loudspeaker to the tuning test signal provided to the loudspeaker prior to (i) the subsequent response of the loudspeaker to the test signal being captured and (ii) the difference between the signature response and the subsequent response being determined.

* * * * *